US005573627A

United States Patent [19]

Vuong

[11] Patent Number: 5,573,627

[45] Date of Patent: Nov. 12, 1996

[54] PORTABLE TAPING MACHINE

[75] Inventor: Cuong T. Vuong, Fountain Valley, Calif.

[73] Assignee: Northrop Grumman Corporation, Los Angeles, Calif.

[21] Appl. No.: 389,535

[22] Filed: Feb. 15, 1995

[51] Int. Cl.[6] ..... B32B 31/00

[52] U.S. Cl. ..... 156/392; 156/425; 156/429; 156/577

[58] Field of Search ..... 156/577, 579, 156/184, 187, 195, 392, 425, 429, 430, 431, 432, 446, 468

[56] References Cited

U.S. PATENT DOCUMENTS

| | | | |
|---|---|---|---|
| 650,522 | 5/1900 | Shellenberger . | |
| 920,737 | 5/1909 | Hardy . | |
| 3,446,446 | 5/1969 | De Bruin | 242/4 |
| 3,547,737 | 12/1970 | Vici | 156/468 |
| 3,580,785 | 5/1971 | Mihalkanin | 156/468 |
| 3,700,010 | 10/1972 | Bartilson et al. | 140/93 A |
| 4,204,905 | 5/1980 | Miyamoto | 156/351 |
| 4,502,905 | 3/1985 | Jung et al. | 156/184 |
| 4,790,896 | 12/1988 | Schmalholtz | 156/392 |
| 4,961,815 | 10/1990 | Buckley et al. | 156/468 |
| 5,041,185 | 8/1991 | Ohashi et al. | 156/468 |

*Primary Examiner*—James Engel
*Attorney, Agent, or Firm*—Terry J. Anderson; Karl J. Hoch, Jr.

[57] ABSTRACT

A portable taping machine for wrapping an elongated article with continuous strip material includes a housing adapted to be gripped by an operator and defines an internal cavity for receiving the article and a passageway communicating with the internal cavity. A taping head including a C-shaped drive wheel with integral gear teeth formed around its periphery is mounted on the housing for rotation about a longitudinal axis which extends through the internal cavity. The drive wheel has a peripheral discontinuity for lateral reception of the article into the internal cavity when the peripheral discontinuity is coextensive with the passageway. When the peripheral discontinuity is substantially non-coextensive with the passageway in the housing, entry of the elongated article into the internal cavity or egress from the internal cavity are prevented. A spindle on the taping head removably supports a supply roll of the strip material on an axis offset from the longitudinal axis of the internal cavity. A motor mounted within the housing rotates a drive gear and with it a pair of pinion gears also drivingly engaged with the drive wheel. The pinion gears are engaged with the drive wheel at locations which are dimensionally no less than the width of the passageway in the housing extending into the internal cavity such that at least one of the pinion gears is in engagement with the drive wheel at all times.

6 Claims, 4 Drawing Sheets

PORTABLE TAPING MACHINE

BACKGROUND OF THE INVENTION

1. Field of the Invention

This invention relates to a taping apparatus, and particularly relates to an apparatus in which a work piece, such as a bundle of elongated members, is peripherally wrapped by manipulating the taping apparatus relative to the work piece.

2. Description of the Prior Art

Various constructions of apparatus have been devised for peripherally wrapping work pieces with flexible pressure sensitive tape. Such work pieces generally comprise a bundle of elongated strands or members which are to be bound together by the flexible tape. Common work pieces suitable for processing by such an apparatus are harnesses used in the electrical industry, particularly as disposed on harness boards. Other work pieces may be peripherally wrapped such as the ends of bags, cylindrical members or others. It is desirable to provide a taping apparatus which can quickly and efficiently wrap such work pieces. It is further desirable to provide a taping apparatus which can operate as a portable unit which can be hand operated for such taping procedures. It will be appreciated that a relatively light weight and compact unit would be highly desirable and, further, one which is rugged and of relatively simple construction.

It is accordingly one important object of the invention to provide a taping apparatus which can directly, quickly and simply wrap a work piece in an improved manner.

Another important object of the invention is a taping apparatus which is compact, portable and hand operated so that it may be used in an improved manner to peripherally wrap work pieces.

It is still another important object of the invention to provide a taping apparatus which is relatively compact and which can be hand manipulated in conjunction with a work piece which is delivered to the apparatus for quick and efficient wrapping by simple insertion, movement of the apparatus relative to the work piece, and withdrawal of the apparatus from the work piece.

Still another object of the invention is to provide such a manual taping apparatus which can apply a wide range of sizes and types of tape to a wide range of sizes and lengths of harnesses.

Yet another object of the invention is to provide a manual taping tool which can engage to and disengage from any section of an electrical harness mounted on a jig board without requiring the harness to feed through the head of the tool or to be removed from the jig board.

A further object of the invention is to provide such a tool which can apply tape to an electrical harness at a range of different pitches, as desired.

Still a further object of the invention is to substantially eliminate vibration which can be caused by the eccentric motion between the tool and the harness due to the type of tapes used and the various harness sizes.

Yet a further object of the invention is to provide such a manual taping tool in which the tool handle is universal and can be applicable to either a right handed or a left handed operator.

Other features of the invention can also be related as follows:

No tape tensioner is required since the tension is created by a naturally resisting force between two opposite rotations. A tape roll needs to rotate in one direction to dispense tape. At the same time, the contact friction between the tape reel and the wire bundle introduces an opposite rotation.

No threading set up is required to change winding direction. For the present invention, a simple procedure requires an operator to rotate the tape roll through an arc of 180 degrees for proper adhesive orientation.

No vibration is generated from an eccentricity between an article to be taped and the rotation center of the taping tool of the invention which has an oscillator arm to provide a floating support to hold a tape roll during rotation. This construction also accommodates reduction of tape roll diameter as the tape is expended.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
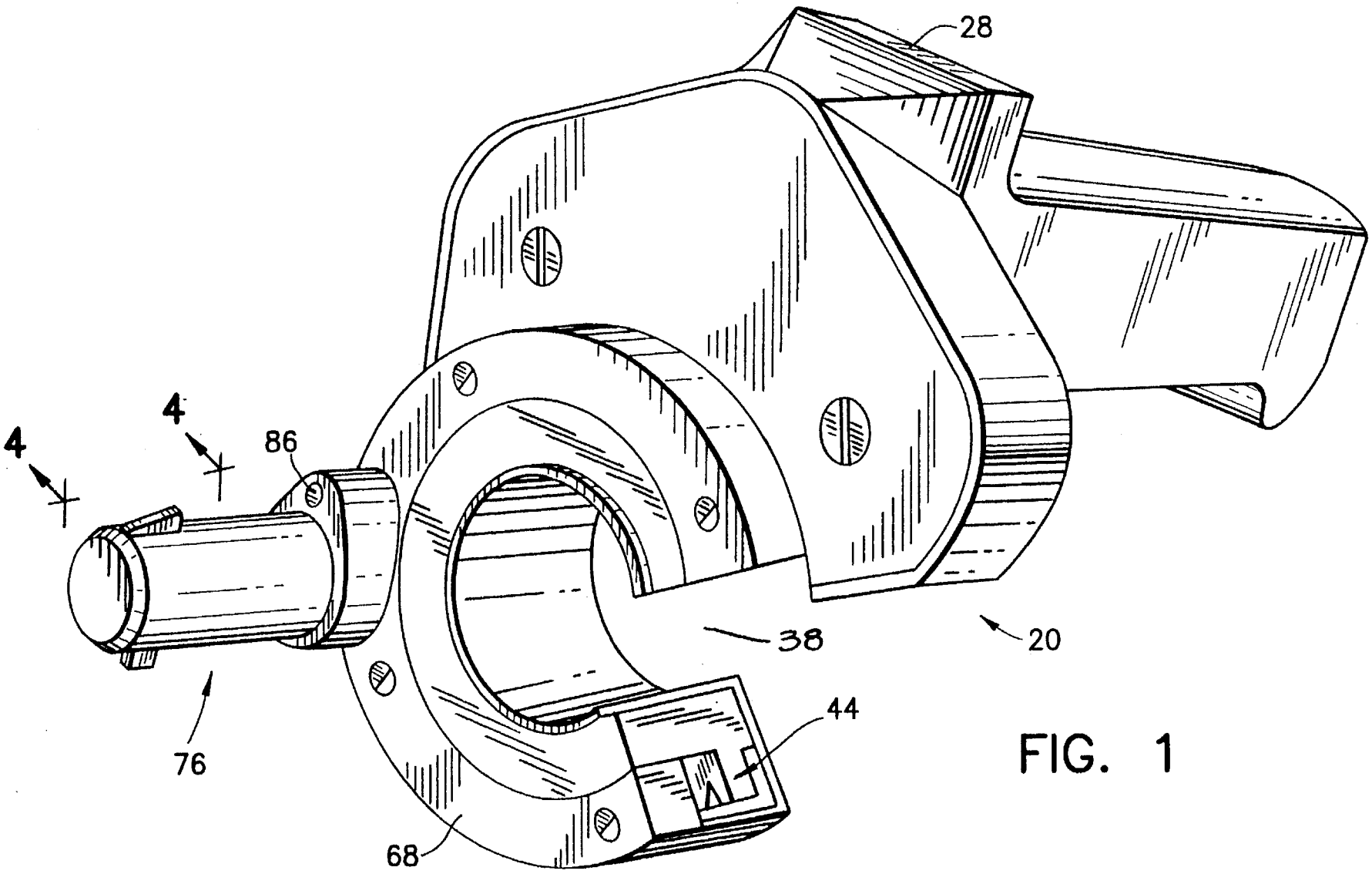
FIG. 1 is a perspective view of a portable taping machine embodying the present invention.

Turn now to the drawings and, initially, to FIG. 1 which generally illustrates a portable taping machine 20 embodying the invention for wrapping continuous strip material 22 onto and around an elongated article 24. The strip material 22 may be, for example, pressure sensitive tape drawn from a supply roll 26. The elongated article 24 may be an electrical wiring harness comprised of many strands of electrical lead which are intended to be gathered together and held in a unified bundle.

The taping machine 20 includes a suitable housing having a main body 30 and a handle 32 and an outer surface 34 adapted to be gripped by an operator. The main body 30 defines an internal cavity 36 for reception therein of the elongated article 22 and a passageway 38 extending between the outer surface and the internal cavity.

Figure 2:
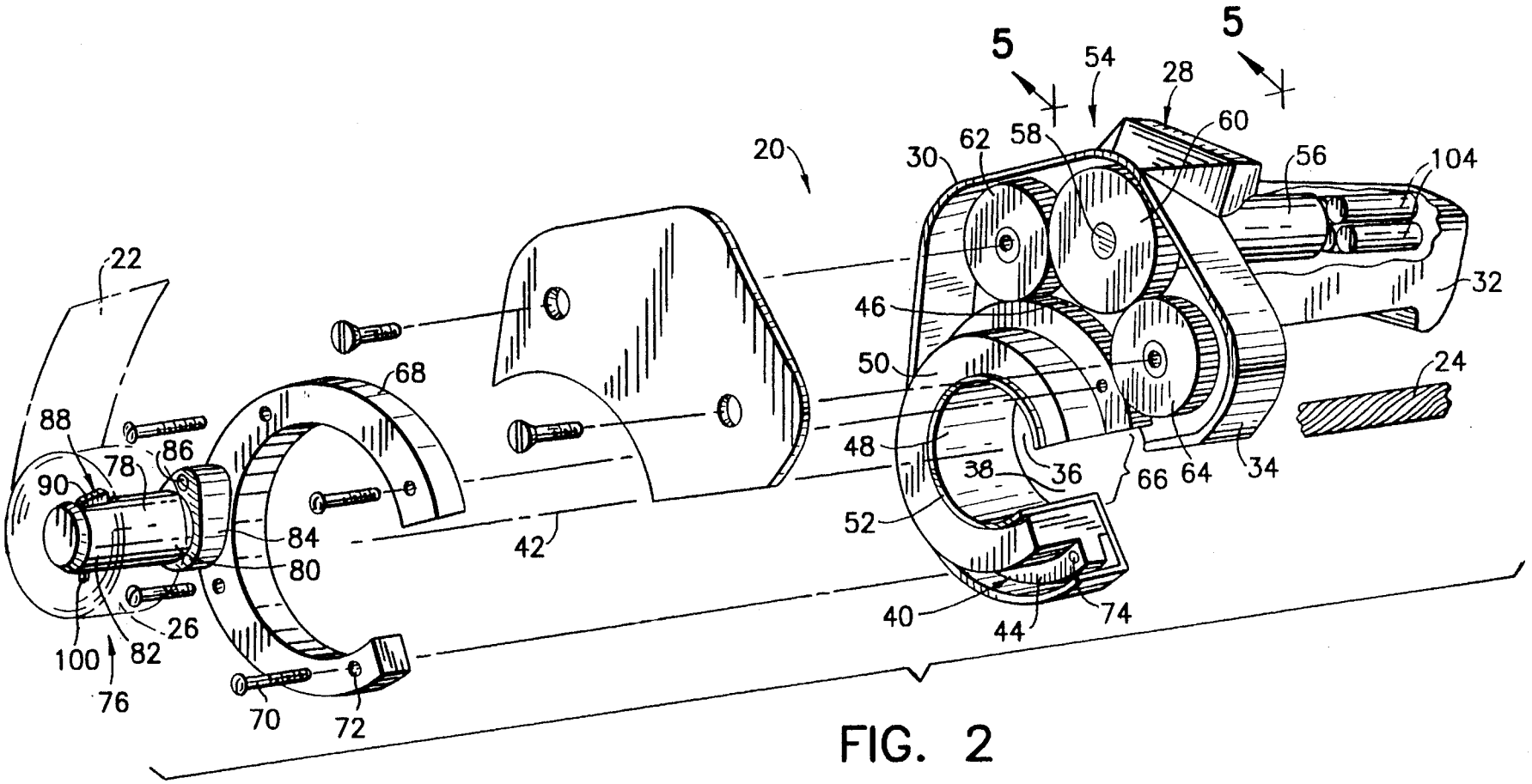
FIG. 2 is an exploded perspective view of the portable taping machine illustrated in FIG. 1.

A taping head mechanism 40 is mounted on the housing 28 for rotation relative thereto about a longitudinal axis 42 (FIG. 2) extending through the internal cavity 36. It includes a C-shaped drive wheel 44 including integral gear teeth 46 around its periphery and an arcuate bearing surface on a longitudinally extending annular flange 50 provided for journaled reception on a similarly longitudinally extending annular flange 52 of the housing 28.

A drive mechanism 54 is also provided within the housing 28 for rotating the taping head mechanism 40 about the longitudinal axis 42. The drive mechanism includes a motor 56, a drive shaft 58 mounted on the housing 28 for rotation by the motor, and a drive gear 60 fixed on a free end of the drive shaft 58 for rotation therewith. A pair of pinion gears 62, 64 are mounted on the housing 28 so as to be operatively engaged with the drive gear 60 for rotation about spaced parallel axes.

It was earlier mentioned that the drive wheel 44 of the taping head mechanism is of generally C-shaped configuration. In this regard, the drive wheel has a peripheral discontinuity 66 provided for lateral reception therethrough of the elongated article 22 into the internal cavity 36 when the peripheral discontinuity is coextensive with the passageway 38 in the housing 28. The taping head mechanism thereby prevents entry of the elongated article 24 into the internal cavity 36 or egress thereof from the internal cavity when the peripheral discontinuity 66 is substantially non-coextensive with the passageway.

Figure 6A:
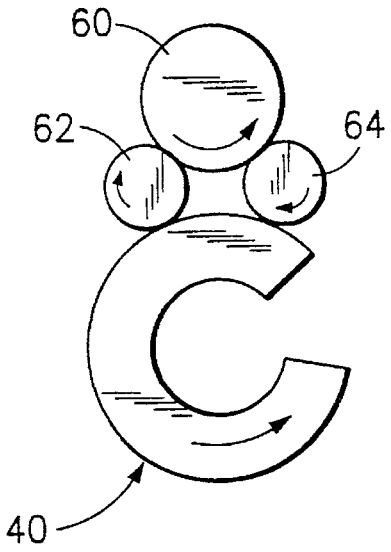
FIGS. 6*a*, 6*b*, 6*c*, and 6*d* all illustrate, diagrammatically, successive positions of components of the portable taping machine of the invention.
Figure 6B:
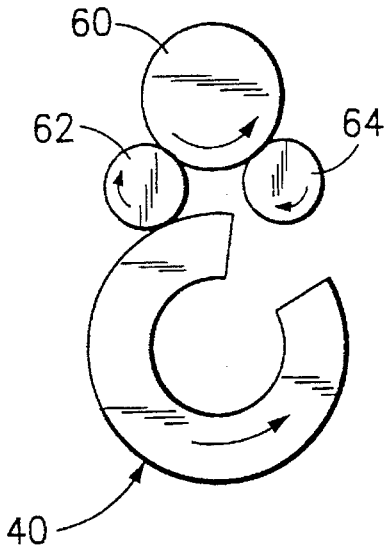
Figure 6C:
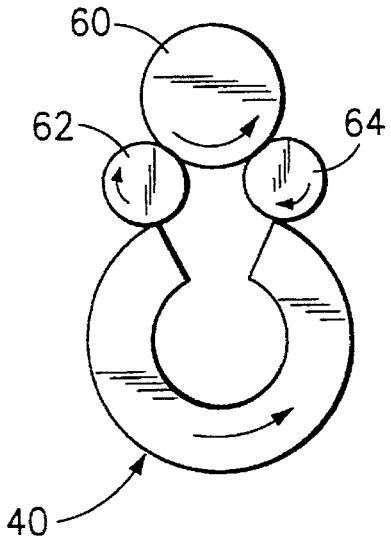
Figure 6D:
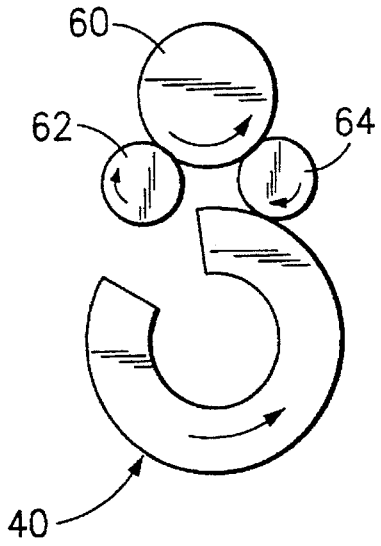

The pinion gears 62, 64 are also operatively engaged with the gear teeth 46 of the drive wheel 44 and such operative engagement is at locations which are dimensionally no less than the width of the passageway 38 in the housing 28 extending between the outer surface 34 and the internal cavity 36. In this manner, at least one of the pinion gears 62, 64 is in engagement with the peripheral gear teeth 46 at all times. This construction is best seen in FIGS. 6*a* through 6*d*. In FIG. 6*a*, both of the pinion gears 62, 64 are operatively engaged with the drive wheel 44 and the peripheral discontinuity 66 will enable ingress and egress of the article 24 relative to the internal cavity 36. However, with continued rotation of the drive wheel 44 about the longitudinal axis 42, the gear teeth 46 move out of engagement with pinion gear 64 (FIG. 6*b*) such that only pinion gear 62 is effective to impart rotation to the drive wheel. As this occurs, the peripheral discontinuity becomes ever smaller, then nonexistent. Then, with continued rotation of the drive wheel 44 (FIG. 6*c*), the gear teeth 46 advance into engagement with pinion gear 64 and temporarily out of engagement with pinion gear 62 (FIG. 6*d*). Finally, the gear teeth 46 advance to the point at which they are again in operative engagement with both pinion gears 62, 64. With this construction, the portable taping machine of the invention is able to receive the elongated article 24 into the internal cavity 36 at any location along its length, yet the drive wheel is free to rotate about the axis 42 whenever such motion is desired.

A C-shaped taping head 68 is of a similar shape and size to the drive wheel 44 and is removably mounted on the drive wheel. This may be achieved by means of suitable fasteners 70 receivable through arcuately spaced clearance holes 72 in the taping head and threadedly engageable with aligned tapped holes 74 in the drive wheel.

A spindle mechanism 76 is mounted on the taping head 68 for removable reception thereon of the supply roll 26. The spindle mechanism 76 includes an elongated shaft 78 having a longitudinal axis generally parallel with and spaced from the longitudinal axis 42 and serves for the releasable reception of the supply roll 26. The shaft extends between a base end 80 and a free end 82. An integral eccentric lobe 84 extends laterally from the base end 80 of the shaft 78 and is pivotally attached to the taping head by a pin 86. This construction enables the shaft 78 to pivot on the taping head 68 and thereby permits lateral movement of the shaft 78 relative to the longitudinal axis 42 while maintaining parallelism between the axis of the shaft and the longitudinal axis 42 so as to accommodate placement on the spindle mechanism 76 of a plurality of supply rolls having a range of diameters. This arrangement also accommodates the reduction in the diameter of a supply roll as the strip material is being wrapped onto the elongated article.

Figure 4:
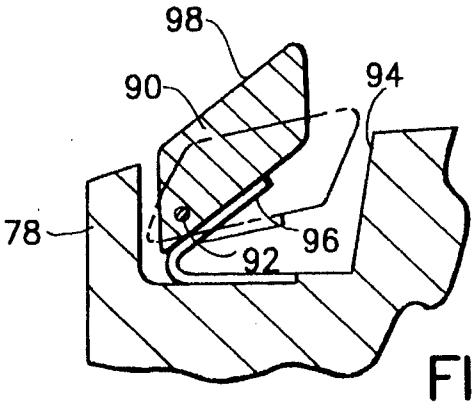
FIG. 4 is a detail cross section view taken generally along line 4—4 in FIG. 1.

The spindle mechanism 76 also includes a suitable latch device 88 which, in turn, includes a gate 90 movable between an extended position indicated by solid lines in FIG. 4 and a retracted position indicated therein by dashed lines. A stub shaft 92 pivotally mounts the gate 90 on the shaft within a hollow 94 at the free end 82 of the shaft. A spring 96 biases the gate 90 to the extended position.

When it comes time to place a fresh supply roll 26 on the spindle mechanism 76, it is positioned in a plane generally parallel with that of the taping head 68 with its central hole concentric with the axis of the shaft 78. As the supply roll is moved toward the taping head, it engages a cam surface 98 on the gate 90 and moves the gate to the retracted position enabling introduction of the roll onto the elongated shaft. When the roll moves onto the shaft and beyond the gate, the gate returns to the closed position to retain the supply roll on the shaft. To remove a supply roll from the shaft, as when it is expended, the operator merely presses down on the cam surface 98 to move the gate to the dashed line position (FIG. 4) enabling the expended roll to be withdrawn. A stub pin 100 on the free end of the shaft 78 diametrically opposite the gate 90 cooperates with the gate 90 in retaining the supply roll on the shaft when the gate is in the extended position.

A taping head mechanism 40 with its associated spindle mechanism 76 may be custom provided for a particular style or size of supply roll. As such, it is desirable to have the capability of removably attaching the taping head to the drive wheel 44. However, it will be understood that it is within the scope of the invention for the spindle mechanism 76 to be pivotally mounted directly on the drive wheel.

A cover 102 is suitably apertured as at 104 to receive therethrough a pair of mounting screws 106. The mounting screws are aligned with longitudinally tapped journal shafts 108 for the pinion gears 62, 64. When in place (FIG. 1), the cover 102 overlies the gears 60, 62, and 64. This construction serves to protect the mechanism of the taping machine and to guard hands and clothing of the user against possible harm.

Figure 5:
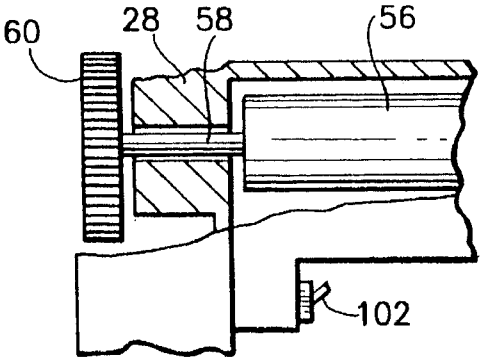
FIG. 5 is a detail side elevation view, certain parts being cut away and shown in section of components illustrated in FIG. 2.
Figure 3:
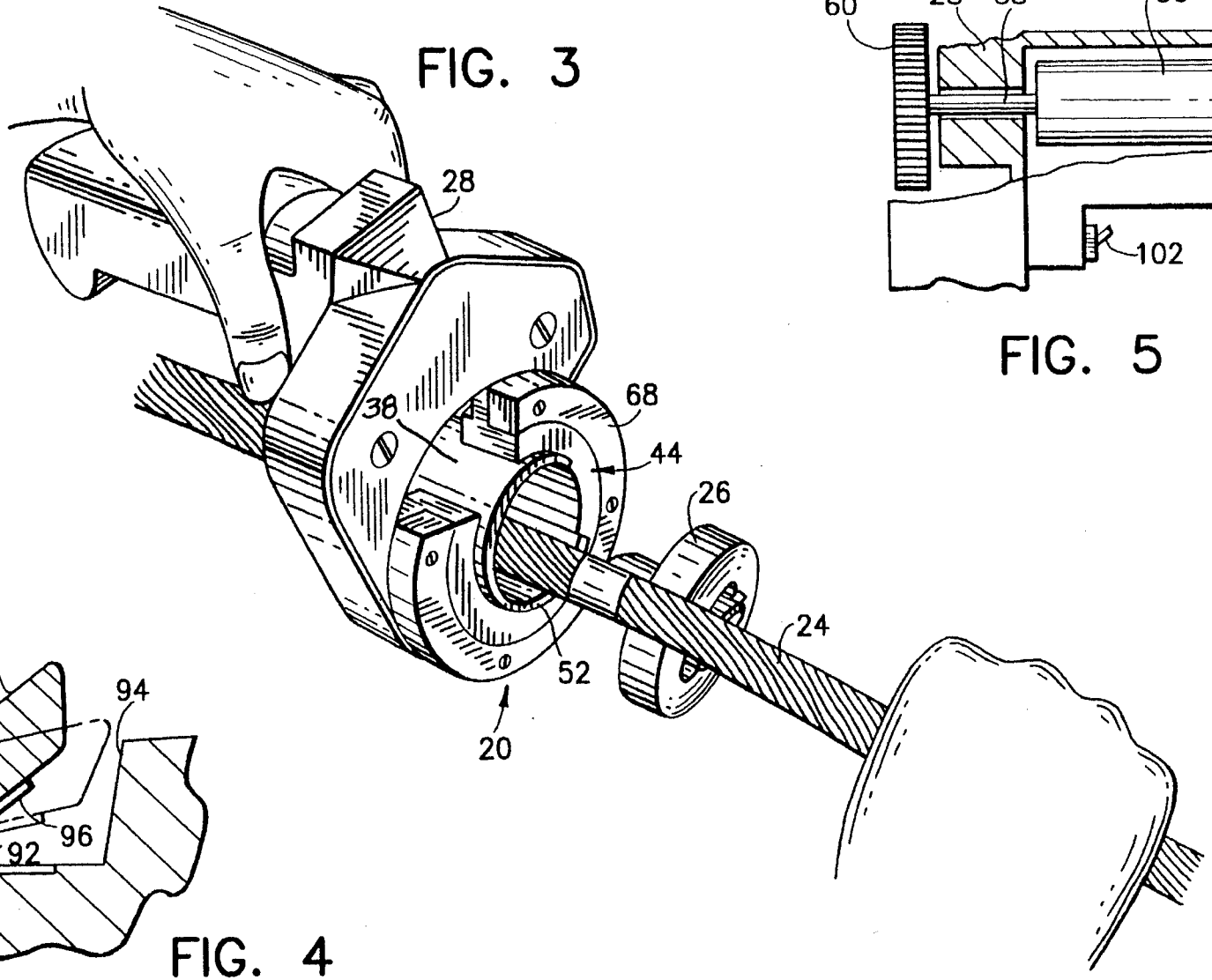
FIG. 3 is a perspective view of the portable taping machine of the invention in use.

In operation, an operator holding the taping machine 20 presses a switch 102 (FIG. 5) to electrically connect the motor 56 to an energy source such as batteries 104. Of course, the motor can also be energized by a suitable A.C. source of electrical energy. The motor is operated for a sufficient duration of time to rotate the drive wheel 44 until the peripheral discontinuity 66 is generally coextensive with the passageway 38. The switch 102 is released and the taping machine advanced toward an elongated article onto which the strip material 22 is to be wound. The elongated article is received through the passageway 38 until it is substantially aligned with the longitudinal axis 42. The operator then draws an end of the strip material 22 from the supply roll and attaches it to the outside surface of the article 24, then again presses the switch 102, causing the drive wheel 44 to rotate. As the drive wheel rotates, the spindle mechanism revolves around the article, to thereby wrap a finite length of the elongated article as the operator simultaneously advances the taping machine lengthwise of the elongated article.

The switch 102 preferably provides for reversing the direction of rotation of the motor 56 which may be desirable, for example, when a right-handed operator is replaced by a left-handed operator, or vice versa.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A portable taping machine for wrapping continuous strip material onto and around an elongated article comprising:

a housing having an outer surface and including handle means adapted to be gripped by an operator and defining an internal cavity for reception therein of the elongated article and a passageway extending between said outer surface and the internal cavity; taping head means mounted on said housing for rotation relative thereto about a first longitudinal axis extending through the internal cavity, said taping head means being of generally C-shaped configuration having a peripheral discontinuity for lateral reception therethrough of the elongated article into the internal cavity when the peripheral discontinuity is coextensive with the passageway in said housing, said taping head means preventing entry of the elongated article into the internal cavity or egress of the elongated article from the internal cavity when the peripheral discontinuity is substantially non-coextensive with the passageway in said housing;

spindle means on said taping head means for removable reception thereon of a supply roll of the continuous strip material, said spindle means having a second longitudinal axis generally parallel with and spaced from the first longitudinal axis, said spindle means including an elongated shaft for releasable reception thereon of the supply roll extending between a base end and a free end, an integral eccentric lobe at said base end extending laterally therefrom, and pin means for pivotally attaching said eccentric lobe to said taping head means enabling movement of the second longitudinal axis relative to the first longitudinal axis to accommodate a plurality of supply rolls having a range of diameters and to accommodate the reduction in the diameter of the supply roll as the strip material is wrapped onto the elongated article; and drive means for rotating said taping head means about the first longitudinal axis after an end of the continuous strip material has been initially attached to the elongated article to thereby wrap a finite length the elongated article as the operator simultaneously advances said taping machine along the length of the elongated article.

2. A portable taping machine as set forth in claim 1 wherein said spindle means includes:

latch means at said free end biased to a closed position and including a cam surface engageable by the supply roll to move said latch means to the open position for introducing the supply roll onto said elongated shaft, said latch means thereafter returning to the closed position to retain the supply roll on said elongated shaft.

3. A portable taping machine as set forth in claim 2 wherein said latch means includes:

a gate movable between an extended and a retracted position;

a stub shaft pivotally mounting said gate; and resilient means biasing said gate to the extended position.

4. A portable taping machine for wrapping continuous strip material onto and around an elongated article comprising:

a housing having an outer surface and including handle means adapted to be gripped by an operator and defining an internal cavity for reception therein of the elongated article and a passageway extending between said outer surface and the internal cavity and including a longitudinally extending annular flange which is coaxial with the first longitudinal axis;

taping head means mounted on said housing for rotation relative thereto about a first longitudinal axis extending through the internal cavity, said taping head means being of generally C-shaped configuration having a peripheral discontinuity for lateral reception therethrough of the elongated article into the internal cavity when the peripheral discontinuity is coextensive with the passageway in said housing, said taping head means preventing entry of the elongated article into the internal cavity or egress of the elongated article from the internal cavity when the peripheral discontinuity is substantially non-coextensive with the passageway in said housing;

spindle means on said taping head means for removable reception thereon of a supply roll of the continuous strip material, said spindle means having a second longitudinal axis generally parallel with and spaced from the first longitudinal axis, said spindle means including an elongated shaft for releasable reception thereon of the supply roll extending between a base end and a free end, an integral eccentric lobe at said base end extending laterally therefrom, and pin means for pivotally attaching said eccentric lobe to said taping head means enabling movement of the second longitudinal axis relative to the first longitudinal axis to accommodate a plurality of supply rolls having a range of diameters and to accommodate the reduction in the diameter of the supply roll as the strip material is wrapped onto the elongated article; and drive means for rotating said taping head means about the first longitudinal axis after an end of the continuous strip material has been initially attached to the elongated article to thereby wrap a finite length the elongated article as the operator simultaneously advances said taping machine along the length of the elongated article, said drive means including a motor mounted within said housing, a drive shaft mounted on said housing for rotation by said motor, a drive gear fixed on said drive shaft for rotation therewith, and first and second pinion gears mounted on said housing operatively engaged with said drive gear for rotation about spaced parallel axes;

said taping head means including a C-shaped drive wheel including integral gear teeth around the periphery thereof operatively engaged with said first and second pinion gears at locations which are dimensionally no less than the width of the passageway in said housing extending between said outer surface and the internal cavity such that at least one of said first and second pinion gears is in engagement with said peripheral gear teeth at all times, a C-shaped taping head having a shape and size similar to said drive wheel, and fastener means for removably mounting said taping head on said drive wheel; and said spindle means being mounted on said taping head for removable reception thereon of the supply roll.

5. A portable taping machine as set forth in claim 4 wherein said spindle means includes:

latch means at said free end biased to a closed position and including a cam surface engageable by the supply roll to move said latch means to the open position for introducing the supply roll onto said elongated shaft, said latch means thereafter returning to the closed position to retain the supply roll on said elongated shaft.

6. A portable taping machine as set forth in claim 5 wherein said latch means includes:

a gate movable between an extended and a retracted position;

a stub shaft pivotally mounting said gate; and resilient means biasing said gate to the extended position.

* * * * *